US008695309B2

(12) United States Patent
Deiss et al.

(10) Patent No.: US 8,695,309 B2
(45) Date of Patent: Apr. 15, 2014

(54) METHOD FOR SEALING OF REPLACEMENT WINDOWS

(71) Applicant: ISO-Chemie GmbH, Aalen (DE)

(72) Inventors: Martin Deiss, Abtsgmuend (DE); Andreas Lange, Urbach (DE)

(73) Assignee: ISO-Chemie GmbH (DE)

( * ) Notice: Subject to any disclaimer, the term of this patent is extended or adjusted under 35 U.S.C. 154(b) by 0 days.

(21) Appl. No.: 13/654,656

(22) Filed: Oct. 18, 2012

(65) Prior Publication Data

US 2013/0276403 A1 Oct. 24, 2013

(30) Foreign Application Priority Data

Oct. 19, 2011 (EP) ..... 11185762
Feb. 23, 2012 (EP) ..... 12156743

(51) Int. Cl.
*E06B 1/56* (2006.01)

(52) U.S. Cl.
USPC ..... 52/746.1; 52/741.4; 52/210; 52/212; 52/656.1; 52/655.1

(58) Field of Classification Search
USPC ..... 52/208–213, 204.1, 204.5, 716.1, 52/741.4, 204.55, 204.591, 746.1, 204.62, 52/204.69, 653.1, 656.1, 656.9, 656.4, 52/656.5, 204.53, 204.54, 745.2, 745.15
See application file for complete search history.

(56) References Cited

U.S. PATENT DOCUMENTS

| | | | | |
|---|---|---|---|---|
| 3,167,823 | A * | 2/1965 | Palfey | 52/172 |
| 4,730,429 | A * | 3/1988 | Roberts | 52/309.13 |
| 5,396,746 | A * | 3/1995 | Whitmer | 52/208 |
| 6,010,180 | A * | 1/2000 | Bureau et al. | 296/146.16 |
| 6,263,636 | B1 * | 7/2001 | Corston | 52/741.1 |
| 6,427,397 | B1 * | 8/2002 | Kolaschnik | 52/204.5 |
| 6,898,907 | B2 * | 5/2005 | Diamond | 52/202 |
| 8,245,463 | B2 * | 8/2012 | Milstead | 52/213 |
| 2006/0053708 | A1 * | 3/2006 | Jacobsen | 52/204.5 |
| 2011/0138724 | A1 * | 6/2011 | Olang | 52/309.4 |
| 2011/0143122 | A1 | 6/2011 | Deiss | |
| 2011/0185661 | A1 | 8/2011 | Nauck et al. | |
| 2011/0302873 | A1 | 12/2011 | Deiss | |

FOREIGN PATENT DOCUMENTS

| | | | |
|---|---|---|---|
| DE | 202005013196 | U1 | 10/2005 |
| EP | 2333177 | A1 | 6/2011 |

* cited by examiner

*Primary Examiner* — Jeanette E. Chapman
(74) *Attorney, Agent, or Firm* — Jansson Munger McKinley & Shape Ltd.

(57) ABSTRACT

In the method for sealing of replacement windows, a sealing tape with a first layer of flexible foam and a second layer of stiff material, which are bonded to each other, is used. The sealing tape is inserted with the second layer facing forward into a channel-shaped recess in the masonry, which is bounded by a bottom and two side walls and comprises an open access section, wherein the first layer of the sealing tape is at least partially compressed when in the inserted state. The second layer of the sealing tape is clamped against the side walls of the recess at a predetermined distance from the open access section. After the window frame has been placed opposite the open access section of the recess, the first layer of the sealing tape expands until it rests against the window frame.

15 Claims, 10 Drawing Sheets

METHOD FOR SEALING OF REPLACEMENT WINDOWS

CROSS REFERENCE TO RELATED APPLICATION

This application claims priority based on European patent application EP 11 185 762.9 filed Oct. 19, 2011 and European patent application EP 12 156 743.2 filed Feb. 23, 2012.

FIELD OF THE INVENTION

The present invention relates to a method for sealing of replacement windows.

BACKGROUND OF THE INVENTION

When windows are being replaced, the usual procedure is first to remove the old window from the masonry wall by the use of, for example, a suitable window joint saw. Both the interior plastering and the exterior rendering are separated from the old window frame along a straight, sharply defined line and the old window frame is then taken out. As a result, the old window which has been removed leaves behind, on all sides, a channel-shaped recess between the interior plastering and the exterior rendering. This recess extends all the way to the rough masonry and can even penetrate into it. Such recesses vary in depth and are usually 10-100 mm deep.

Modern window frames are usually wider than old window frames, which means that, when a new window is being installed, the window frame cannot be inserted into the recess but rather must remain outside it. The recess extending all the way around must be filled with a sealing and insulating material, so that, after the new window has been installed, the space between the bottom of the recess and the new window frame is sealed in a manner consistent with good building insulation as defined by the generally recognized rules of the technology.

Injected polyurethane foams or mineral fiber insulating materials, for example, have been used in the past to seal these recesses. Sealing tapes of flexible foam are also used.

In the case of the latter option, advantageous embodiments of flexible foam sealing tapes are attached directly to the new window frame. For example, a window frame equipped with a flexible foam sealing tape is known from US 2011/0185661 A1. The sealing tape can be held in place between the opposing angled edges of two molding profile strips on the window frame. This is done by introducing the stiff layer, on which the flexible foam is mounted, into the intermediate space between the molding profile strips, where it is prevented from slipping out of position by the angled edges. The stiff layer is then destroyed to release the foam, which can finally expand and seal the window frame in the direction toward the masonry. In the case of the previously mentioned process of window replacement, however, it is very difficult to reach the stiff layer after the new window frame has been brought into the desired installation position, and it is also impossible to see whether or not the recess has been sealed completely with the flexible foam strip.

According to US 2011/0143122 A1 and US 2011/0302873 A1, the sealing tape again comprises a layer of flexible foam and a stiff layer. Here, the stiff layer does not have to be destroyed to release the flexible foam, and the flexible foam is arranged on the side of the stiff layer facing the masonry. The stiff layer can be premounted in profiled channels in the window frame by the use of various fastening mechanisms.

However, it is still impossible to see whether or not the recess has been sealed completely with the flexible foam strip.

Summarizing, the combination of a window frame with a sealing tape already premounted on it is not optimally suitable for the window replacement process described above.

SUMMARY OF THE INVENTION

It is an object of the present invention to provide a method for sealing of replacement windows by means of which the sealing of the new window frame in the masonry can be ensured efficiently and reliably, and which at the same time can be carried out easily by the tradesman.

According to an aspect of the invention, the method for sealing of replacement windows comprises the steps of:

- providing a sealing tape comprising a first layer of flexible foam, which recovers after compression, and a second layer of stiff material, the first and second layers being bonded to each other;
- inserting the sealing tape into a channel-shaped recess in masonry which is bounded by a bottom and two side walls and comprises an open access section, wherein the second layer of the sealing tape is arranged closer to the bottom of the recess than the first layer, and wherein the first layer of the sealing tape is at least partially compressed when in the inserted state;
- fastening the second layer of the sealing tape in the recess at a predetermined distance from the open access section; and
- placing a window frame opposite the access section of the recess provided with the sealing tape,
- whereupon the first layer of the sealing tape expands until it rests against the window frame.

With a method such as this, it is possible to ensure that the joint formed between the new window frame and the old masonry can be sealed completely and reliably. A two-stage process is created, according to which the channel-shaped recess in the masonry is first provided with sealing tape, which is in the partially compressed state on installation and which does not expand against the window frame until after the window frame has been put in place.

The sealing function and handling of the sealing tape can be further improved by making the second layer of the sealing tape out of stiff foam.

The second layer of the sealing tape is preferably clamped against the side walls of the recess. In this way it is possible to position the sealing tape in the recess and to hold it in place there without any additional aids.

In a preferred embodiment, the second layer of the sealing tape comprises two predetermined bending lines to define two lateral clamping sections. This guarantees that the sealing tape can be clamped especially securely in the recess regardless of the shape and surface conditions of the side walls of the recess.

The sealing tape can be clamped in the recess over an even wider area if the two lateral clamping sections are able to fold over in the opposite direction, i.e., toward the open access section, when the sealing tape is inserted into the recess. Thus recesses of different widths can be sealed with the same sealing tape, because the folding clamping sections are able to bridge recesses of varying width.

Alternatively or in addition to the clamping of the second layer of the sealing tape against the side walls of the recess, the second layer of the sealing tape can also be fastened to the side walls of the recess by an adhesive. For this purpose, the adhesive can be provided on the side areas of the second layer which come in contact with the side walls of the recess. An adhesive can also be applied to the side walls or to certain sections of the side walls of the recess. A combination of these two application possibilities is also conceivable.

To facilitate handling, the first layer and the second layer of the sealing tape are preferably permanently bonded to each other.

In a preferred embodiment, the first layer of the sealing tape is provided with a sticky impregnation agent, which delays the recovery of the first layer after compression. In this way, the expansion of the first layer after insertion of the sealing tape in the recess is delayed at least until the window frame is installed, this delaying effect being easily achieved without the need for any additional aids.

Alternatively or in addition, the first layer of the sealing tape can be at least partially surrounded by a sheet-like wrapping, which keeps the first layer at least partially compressed after it has been inserted, wherein the wrapping is opened or removed after the window frame has been put in place. In this way, even foams which expand more quickly can be used as the material of the first layer without creating handling problems for the tradesmen.

The predetermined distance of the second layer of the sealing tape from the open access section of the recess is preferably 2-20 mm, more preferably 5-10 mm. Because the window frame is usually arranged not much more than 5-10 mm from the open access section of the recess so as to lose the least possible amount of window surface area, there therefore remains a permanently defined sealing depth between the second layer of the sealing tape and the window frame; this is the depth which must be bridged by the first layer of the sealing tape. This sealing depth can be easily sealed with conventional flexible foam materials in a manner which complies with the relevant standards concerning leak-tightness versus air and driving rain. In contrast, only thermal insulation must be provided in the intermediate space between the second layer of the sealing tape and the bottom of the recess. This can be done by the use of suitable insulating material or simply with the help of the air present in the intermediate space. The size of the intermediate space plays an important role with respect to the choice of suitable thermal insulation.

In a more complex embodiment, the sealing tape can comprise a third layer of flexible foam which recovers after compression. This layer is bonded to the second layer of the sealing tape on the side of the second layer opposite the first layer and, after the sealing tape has been fitted into the recess, it will be located in the intermediate space between the second layer of the sealing tape and the bottom of the recess. This embodiment is especially suitable for large intermediate spaces between the bottom of the recess and the second layer of the sealing tape. In this case, there is no need to introduce additional insulating material into the intermediate space.

If a separate insulating material is used for the intermediate space, it is advantageous for this insulating material to be inserted before the sealing tape is fitted into the recess, so that, after the sealing tape has been fitted into the recess, the insulating material will be located in the intermediate space between the second layer of the sealing tape and the bottom of the recess. The goal here is to avoid undesirable convection effects and thermal bridges in this intermediate space even in cases where the intermediate spaces between the second layer of the sealing tape and the bottom of the recess are large.

A compressible, flexible foam strip or polyurethane foam, which is injected into the recess, can be used as the insulating material, for example.

To ensure that the flexible foam conforms closely to the contours of the window frame and that a reliable seal is obtained even if those contours are irregular, the first layer of the sealing tape comprises, in a special embodiment, a plurality of 3-dimensional foam segments, which are separated from each other by cuts, which extend from the top, i.e., from the side facing away from the second layer of the sealing tape, into the first layer of the sealing tape, wherein, when the first layer is in the expanded state, the foam segments extend over at least 50% of its height, preferably over at least 60% of its height, more preferably over at least 70% of its height, and even more preferably over 90% of its height.

To simplify production and to create uniform foam segments, a plurality of cuts is preferably substantially parallel to the side walls of the recess, and another plurality of cuts is substantially perpendicular to the side walls of the recess, so that the foam segments comprise a rectangular outline. Alternatively, the cuts can extend at an angle to the side walls of the recess, so that the foam segments comprise a rhombic outline. Other geometric forms are also conceivable, as is the use of dimpled foam.

BRIEF DESCRIPTION OF THE DRAWINGS

Additional features and advantages of the invention can be derived from the following description, which refers to the drawings.

DETAILED DESCRIPTION OF THE INVENTION

Figure 1:
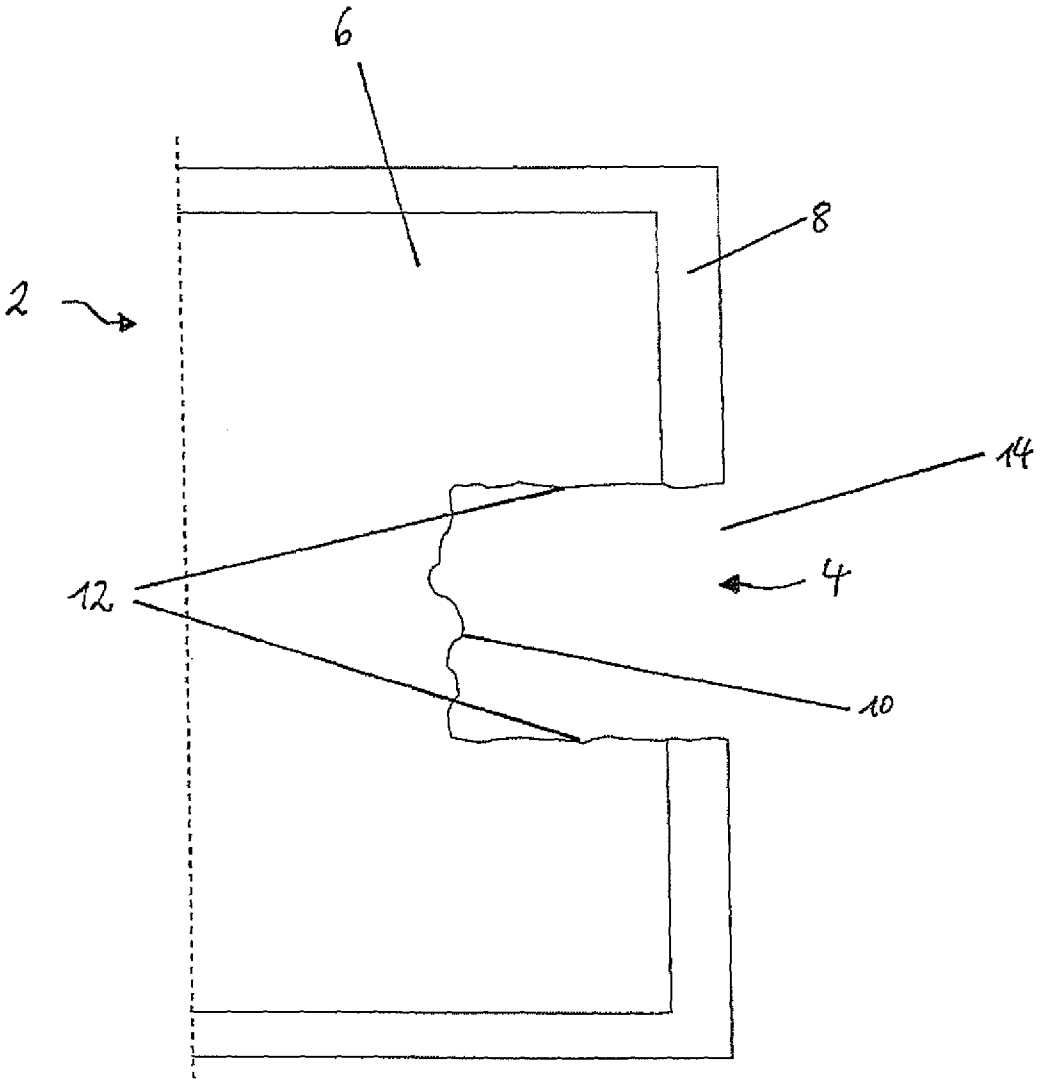
FIG. 1 is a cross-sectional view of a channel-shaped recess in the masonry of a building.

FIG. 1 shows the masonry 2 of a building, in which a recess 4 is present. Masonry 2 in the example shown here is formed out of a rough masonry core 6, over which plaster 8 has been applied. Recess 4 is in the shape of a channel and comprises a bottom 10, two side walls 12, and an access section 14 open to the outside.

Recesses 4 of this type in masonry 2 are usually encountered when a window is being replaced, that is, when the old window frame has been cut out of masonry wall 2 with a window joint saw and removed. When the previously mentioned saw is used, side walls 12 of the resulting recess 4 are usually relatively smooth, whereas bottom 10 of recess 4 can be quite bumpy. It is obvious that recess 4 extends all the way around the opening and that the cross-sectional view in FIG. 1 shows only one of the usually four sides of the window opening in the masonry 2.

The height of masonry 2 on one side of recess 4 can also be offset from that of masonry 2 on the other side of recess 4 (not shown), thus creating, for example, an outside stop for the window.

Figure 2A:
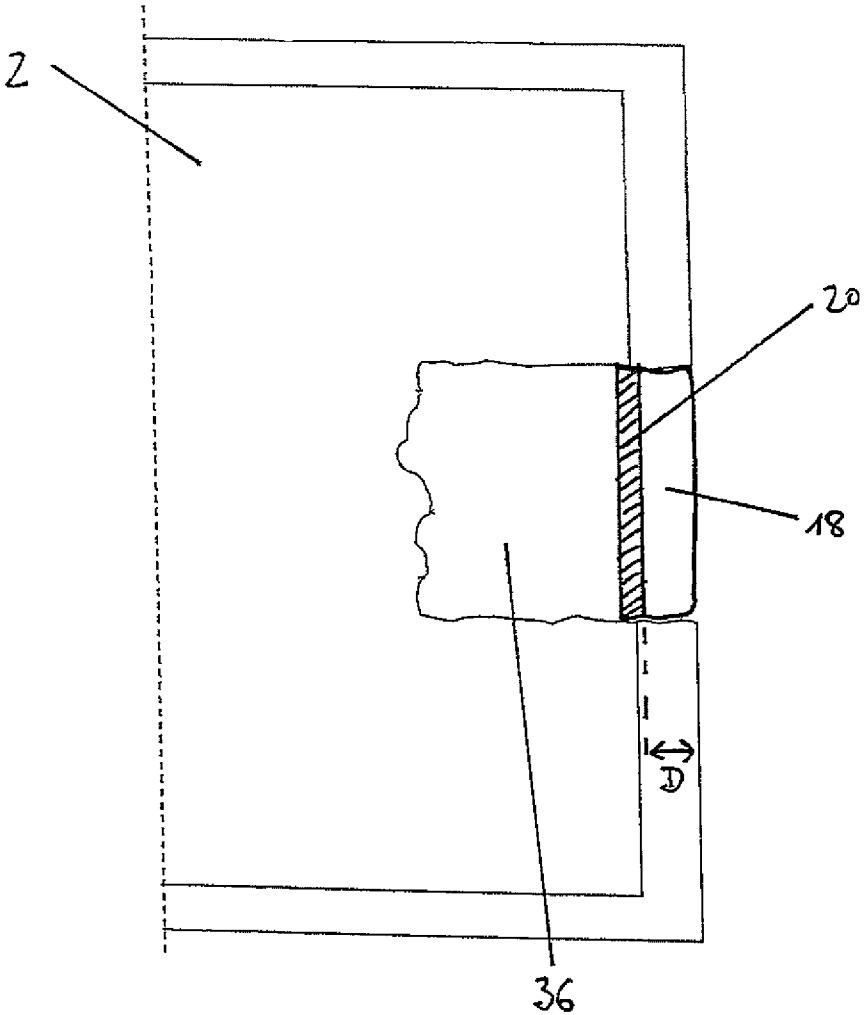
FIGS. 2*a*-2*c* are cross-sectional views of the masonry of FIG. 1, illustrating the series of steps of the sealing process during window replacement according to a first embodiment of the invention.

Sealing tape 16 is now introduced into the recess, as shown in FIG. 2*a*.

Figure 3:
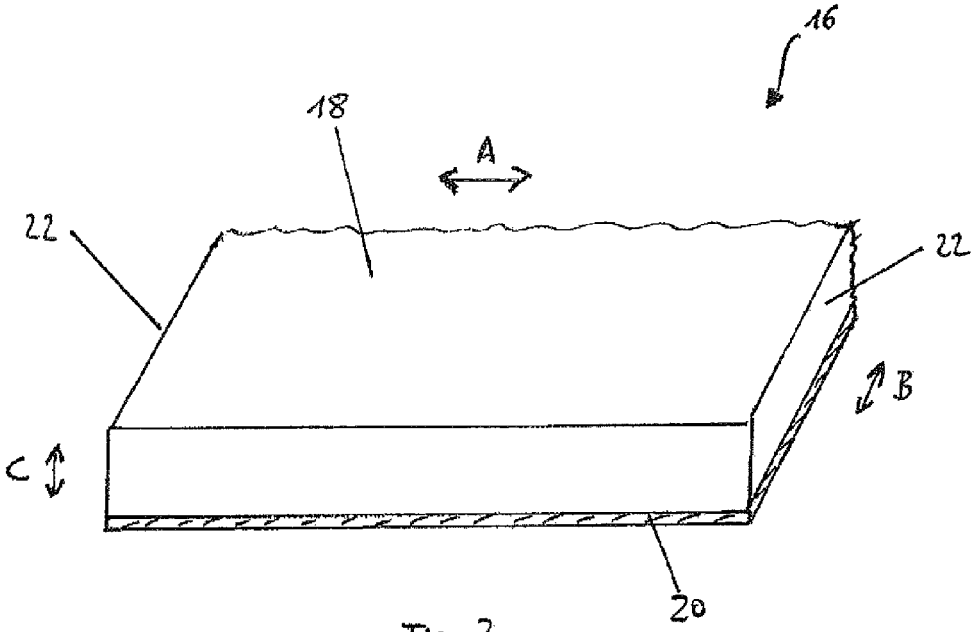
FIG. 3 is a schematic perspective view of the sealing tape used in FIGS. 2*a*-2*c;*

Details of sealing tape 16 used in FIG. 2*a* will now be described with reference to FIG. 3. In the exemplary embodiment shown here, sealing tape 16 has a rectangular cross section, but other shapes are also possible. Basically, sealing tape 16 can be produced either in the form of strips or in the form of rolls of sealing tape.

Sealing tape 16 consists of a first layer 18 of flexible foam, which, in the expanded state, has a thickness in the range of 5-150 mm, preferably of 20-100 mm, and a width in the range of 10-250 mm, preferably of 40-100 mm.

First layer 18 of the sealing tape can be made of any desired open-cell or closed-cell flexible foam such as a polyurethane or polyethylene foam which recovers after compression. The foam can be impregnated to delay its recovery after compression. The density of flexible foams of this type is usually in the range of 20-200 kg/m$^3$.

Because of the purpose which it is intended to serve, sealing tape 16 extends farther in its longitudinal direction (arrow B) than in its transverse direction (arrow A), wherein the transverse direction simultaneously represents the functional direction of sealing tape 16 and extends between the two side surfaces 22 of first layer 18. In practice, first layer 18 of the sealing tape is usually precompressed in such a way that, when the pressure on it is released, it can expand preferably to a thickness approximately 5-10 times greater than that which it had in the precompressed state, although, to guarantee secure installation against the window frame 24 (FIG. 2*c*) only about half of this capacity for expansion is actually used in many cases. Arrow C indicates the direction in which compression and expansion occur.

A second, thinner stiff layer 20 of the sealing tape is arranged on the bottom side of first layer 18 of the sealing tape. Second layer 20 is bonded to first layer 18 preferably by means of an adhesive or by lamination. The thickness of second layer 20 is in the range of 1-10 mm, preferably of 2-5 mm.

A foam of greater, preferably of much greater, stiffness than the flexible foam of first layer 18 is preferably provided as a material for second layer 20. For the stiff foam of second layer 20, therefore, plastics of foamed polyethylene or polypropylene can be considered.

The material of second layer 20 could also be a stiff material such as a nonwoven or mesh material. Strips of plastic or some other material which is suitable for the purpose indicated could also be used. Combinations of the materials mentioned above are also possible.

Second layer 20 generally has a flexural strength of more than 200 kPa, preferably of more than 250 kPa. In a preferred embodiment, second layer 20 has a flexural strength of more than 300 kPa, preferably of more than 400 kPa. In an especially preferred embodiment, the second layer 20 has a flexural strength of more than 500 kPa, preferably of more than 1,000 kPa, and even more preferably of more than 2,000 kPa. At the same time, the material of second layer 20 must be elastic enough not to break during the inventive application. 10,000 kPa, for example, represents an upper limit for the flexural strength.

The foam material of first layer 18, however, has a flexural strength of less than 150 kPa, preferably of less than 125 kPa, and more preferably of less than 100 kPa. In any case, however, it will always be more than 0 kPa.

The flexural strengths of the material of second layer 20 and of first layer 18 are determined on the basis of the standard ISO 1209-2, third edition, of 2007. This international standard is usually used to measure the flexural strength of plastics, but in somewhat modified form it is also an excellent way of measuring the flexural strength of foams.

A uniformly changing force is applied perpendicularly to the middle of a test piece extending between two support points. The flexural strength is calculated from the measured force-versus-deformation curve (see Section 3 of ISO 1209-2). The test apparatus is shown in greater detail in Section 4, FIG. 1. An example of a suitable testing device is the model BZ2.5/TN1S from Zwick of Ulm, Germany. In the present case, a model KAP-Z load cell for forces up to 200 N, for example, was used in the device.

The support points consist of two parallel cylindrical support elements, which are arranged horizontally in the same plane and each of which has a radius of 15±1 mm. The length of the support elements is greater than the width of the test pieces. In the present case, the support elements are 80 mm long.

The distance L between the support elements for the present measurement deviates from that of ISO 1209-2 and is fixed instead at 85±2 mm. The force-transmitting element has the same shape as the support elements. The other dimensions given in Section 5.1 of ISO 1209-2 are adjusted for the special purpose of measuring foams. Each measured foam test piece is a block with a length l of 150±3 mm, a width b of 40±2 mm, and a thickness d of 3.0±0.2 mm. Of the sets of test conditions described in Section 6 of ISO 1209-2, the first is used; that is, the measurement is carried out at a temperature of 23±2° C. and at a relative humidity of 50±10%. Instead of the velocity value given for the movement of the force-transmitting element in Section 7 of ISO 1209-2, a velocity of only 10±1 mm per minute is used here. In addition, the force is measured up to a maximum deflection of the foam of 20 mm, and the maximum value $F_R$ of the force observed during the course of the measurement is recorded.

The calculation of the flexural strength R (in kPa) is described in Section 8.1 of the ISO 1209-2; that is, the formula $R=1.5\ F_R \cdot L/bd^2 \cdot 10^6$ is used, where $F_R$ is the maximum applied force in kN; L is the distance between the support elements in mm; b is the width of the test piece in mm; and d is the thickness of the test piece in mm.

For the values of L, b, and d given above, the results cited above for the material of second layer 20 and for that of first layer 18 are obtained from the measured force $F_R$.

Reference is now made again to FIG. 2*a*. The Sealing tape 16 is introduced into channel-shaped recess 4 with second layer 20 facing forward. In other words, second layer 20 of the sealing tape is arranged closer to bottom 10 of recess 4 than first layer 18 is. In the inserted state, first layer 18 of the sealing tape is at least partially compressed.

In the example shown here, the width of sealing tape 16 corresponds approximately to the width of recess 4, but it is also possible for first layer 18 of sealing tape 16 to be narrower than recess 4, as will be described below. It is also conceivable that sealing tape 16 could be, within certain limits, wider than recess 4 and thus be somewhat compressed in the width direction after the tape has been fitted into recess 4.

Second layer 20 of the sealing tape must in all cases be of such width and of such a shape that, in the absence of any outside influences, it will support itself against side walls 12 of recess 4 and clamp itself there preferably without any further aids. Therefore, when the sealing tape 16 is being introduced into recess 4, the second layer must be pushed actively forward against the clamping force until the desired end position is reached. The distance D of this desired end position of second layer 20 of sealing tape 16 clamped against side walls 12 of recess 4 from open access section 14 is preferably 2-20 mm, more preferably 5-10 mm. The distance D to open access section 14 should be measured here from the surface of second layer 20 which is closer to open access section 14. As a result of the introduction of sealing tape 16 into recess 4 to the desired end position, an intermediate space 36 is also created between bottom 10 of recess 4 and second layer 20 of sealing tape 16.

Figure 2B:
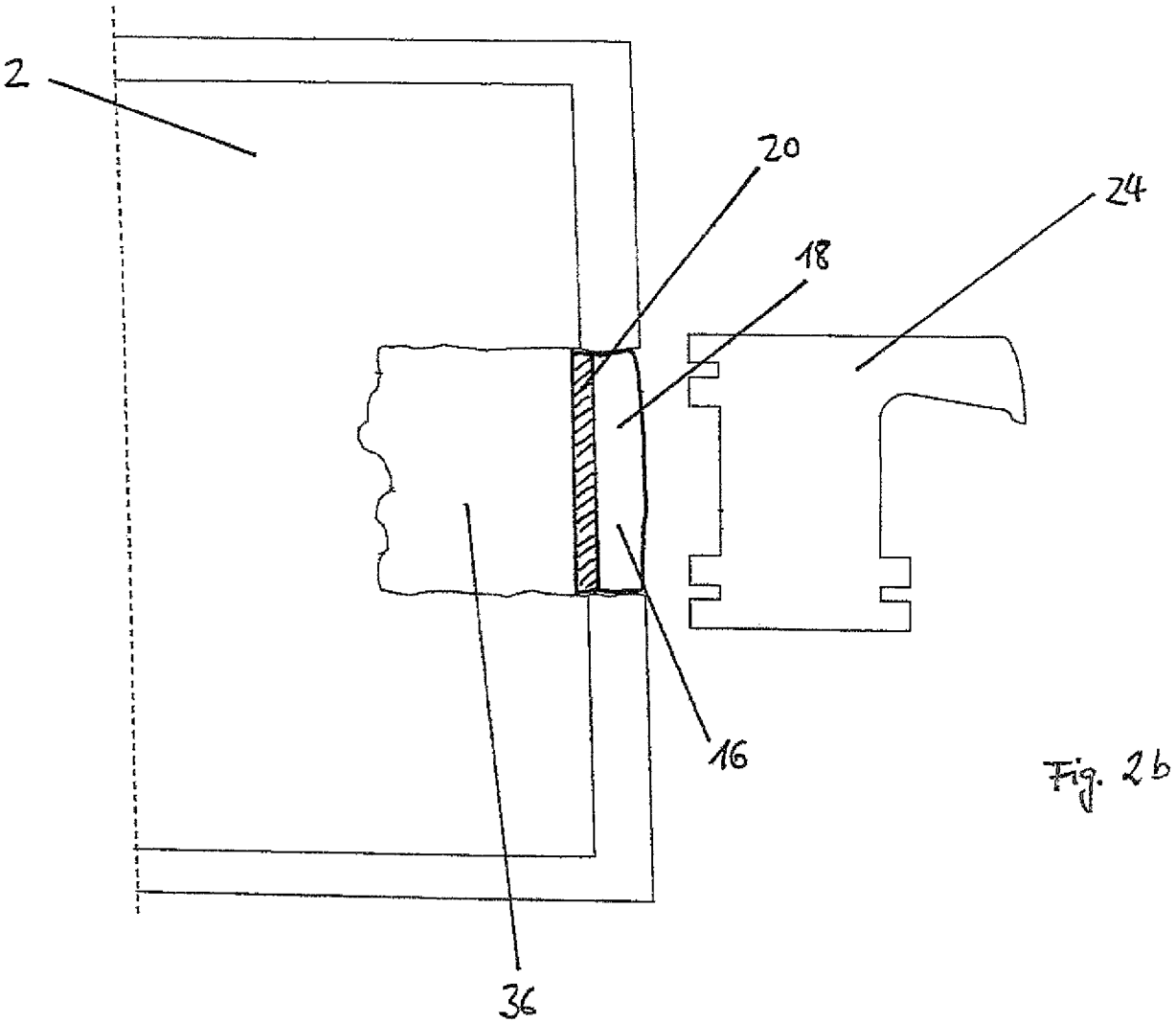

As can be seen in FIG. 2*b*, new window frame 24 is now put in place in the area of recess 4 filled with sealing tape 16. More precisely, it is put in place opposite open access section 14 of recess 4 provided with sealing tape 16. Because new window frames 24 are usually somewhat wider than old window frames, new window frame 24 projects somewhat beyond both sides of recess 4. The invention can still be used even when this is not the case, however. Window frame 24 is usually placed in such a way that a planned gap of at least 5 mm remains on all sides between it and masonry 2. After window frame 24 has been aligned in the window opening, it is fastened to masonry 2 by means of screws (not shown), for example.

Figure 2C:
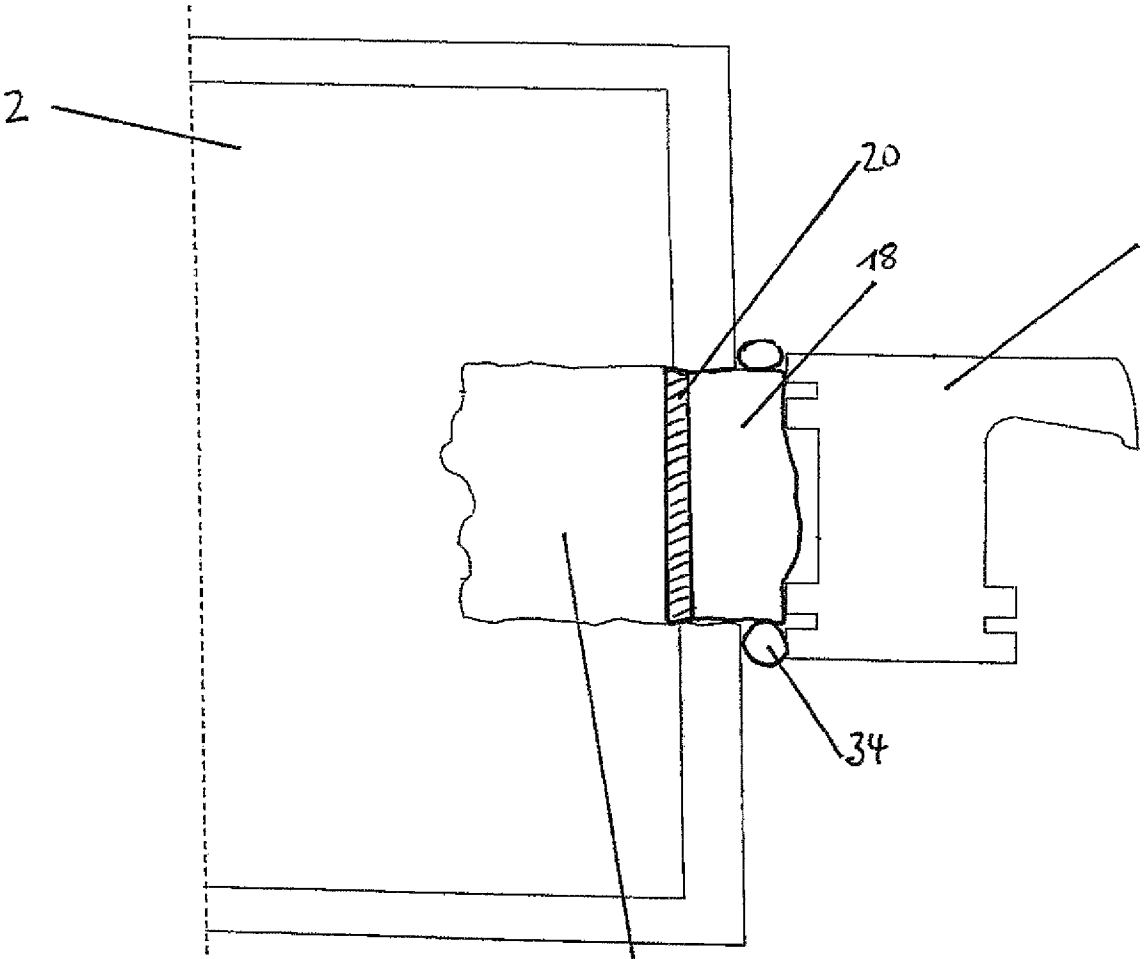

After window frame 24 has been installed, first layer 18 slowly and continuously expands toward window frame 24 until it ultimately rests against window frame 24 (see FIG. 2*c*). In this final installation state, first layer 18 of the sealing tape still has a certain expansive force, so that a reliable seal is ensured in the direction toward window frame 24. If necessary, additional sealing elements 34 or sealants can also be inserted or injected between window frame 24 and masonry 2 on one or both sides of sealing tape 16. Alternatively, the still visible joint between masonry 2 and window frame 24 can be covered by a strip of plastic, for example.

The recovery of first layer 18 after compression is usually delayed by the use of a sticky impregnation agent, with which the flexible foam of the first layer has been treated. The delay times which are achieved can range from a few seconds to several hours. After sealing tape 16 has been unwound from the roll and after sealing tape 16 has been fitted into recess 4, first layer 18 therefore remains in an at least partially compressed state for at least a certain period of time, before the expansive pressure intrinsic to the foam gradually causes first layer 18 to expand. During this process, there is enough time to insert window frame 24 which first layer 18 is intended to seal when in its functional state. It is also possible, however, to use non-impregnated foams as material for first layer 18, provided that they are temporarily prevented from expanding by means of, for example, a tear-off wrapper, as will be described in greater detail below on the basis of FIG. 9.

Figure 4:
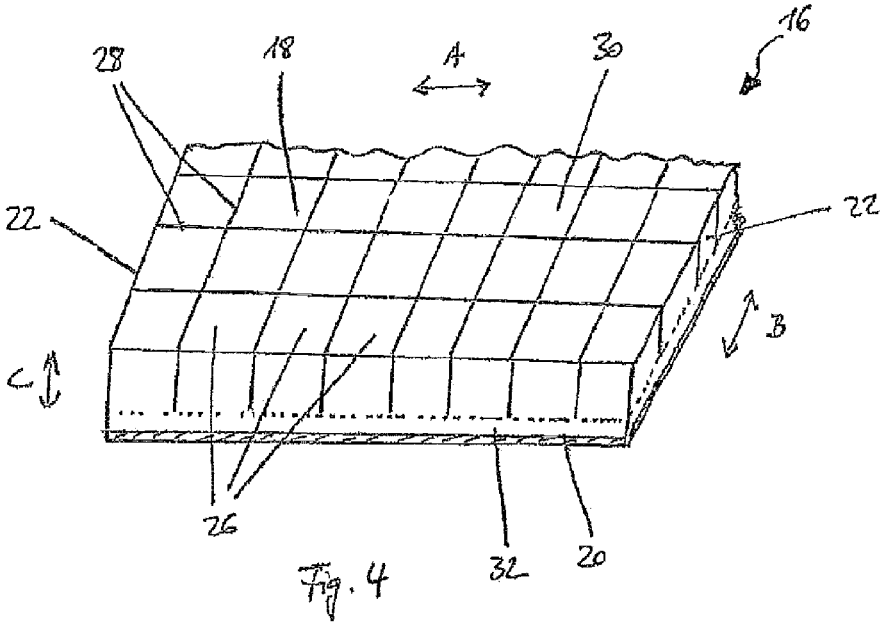
FIG. 4 is a schematic perspective view of an alternative embodiment of the sealing tape.

FIG. 4 shows another embodiment of sealing tape 16 which is suitable for inventive use. First layer 18 of the sealing tape is not designed here as a one-piece foam block as shown in FIG. 3 but rather comprises several foam segments 26. In the present case, these are arranged in rows and columns. Foam segments 26 are formed by cuts 28, i.e., they are separated from each other by the cuts 28.

All of cuts 28 extend from the top side 30 into first layer 18 of the sealing tape. When first layer 18 of the sealing tape is in the expanded state, cuts 28 and thus foam segments 26 extend over at least 50% of the height of the layer, preferably up to at least 90% of its height. In the area of the bottom side of first layer 18 of the sealing tape, a web 32 can remain, which connects foam segments 26 to each other. This web 32 is separated in FIG. 4 by a dotted line from foam segments 26 but in reality is an integral part of them.

In the present example, one set of cuts 28 is substantially parallel to side surfaces 22 of first layer 18 of the sealing tape, and the other set of cuts 28 is substantially perpendicular to side surfaces 22 of first layer 18 of the sealing tape, as a result of which foam segments 26 acquire a rectangular outline. When seen from above, foam segments 26 thus form a checkerboard pattern. In this way, each of a majority of foam segments 26, that is, all of foam segments 26 except those located at the edge of sealing tape 16, is completely surrounded in the longitudinal direction B and in the transverse direction A of sealing tape 16 by other foam segments 26.

In addition to the design and direction of cuts 28 shown here, many other designs are also conceivable. For example, cuts 28 can extend only in the longitudinal direction B of sealing tape 16 or at an angle or in zigzag fashion through sealing tape 16. They could also be wave-like or have any other desired, preferably regular, configuration. Accordingly, the shape of individual foam segments 26 can also deviate from the block-like shape shown in FIG. 4. For example, foam segments 26 can be given a rhombic outline. Cuts 28 can also extend at an angle from top to bottom. Nearly any 3-dimensional design of foam segments 26 is possible.

Cuts 28 are usually extremely narrow, and they are produced by displacement cutting, i.e., a form of cutting which does not result in the loss of any material when cuts 28 are made in the flexible foam of first layer 18. It is also possible to produce cuts 28 by punching foam material out of first layer 18 of the sealing tape, if this is deemed advantageous for certain applications. As a rule, however, it is preferable to make cuts 28 as narrow as possible and to lose as little material as possible when making cuts 28, so that the sealing action of sealing tape 16 remains as strong as possible.

Cuts 28 could also extend over the entire height of first layer 18 of the sealing tape, so that individual foam segments 26 are connected to each other only by second layer 20.

Foam segments 26 can also be arranged a certain distance apart (not shown), and they can also consist of different materials. The latter option offers advantages, for example, when the permeability to air or the vapor diffusion in the inner area is to be different from that in the outer area of the masonry ("inside tighter than outside").

Figure 5:
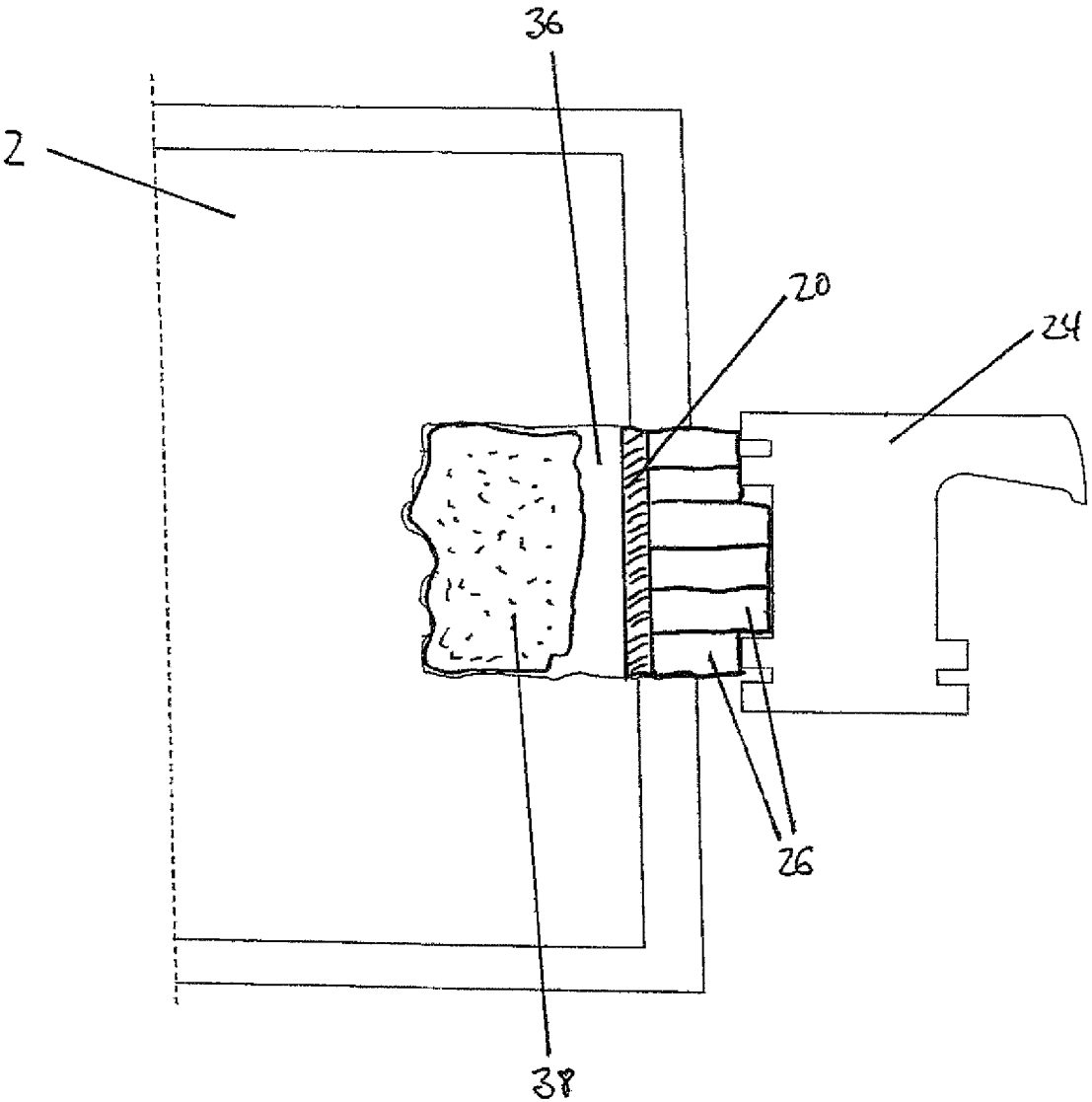
FIG. 5 is a cross-sectional view of the masonry of FIG. 1 with an installed window frame and the sealing tape of FIG. 4.

FIG. 5 shows schematically the desired functional state of sealing tape 16 of FIG. 4. It can be seen how even major irregularities in the profile of window frame 24 can be compensated by sealing tape 16 as a result of the ability of individual foam segments 26 to expand independently of each other, thus ensuring that foam segments 26 make good contact with the window frame 24 and produce a reliable seal.

In the normal case, as shown in FIGS. 2*a*-2*c*, the intermediate space 36 between bottom 10 of recess 4 and second layer 20 of sealing tape 16 is not filled, but contains only the air enclosed within it, which can provide adequate thermal insulation. In the case of larger intermediate spaces 36, however, undesirable convection effects and thermal bridges can form within intermediate space 36, which detract from the effectiveness of the insulation. Therefore, as shown in FIG. 5, additional insulating material 38 is inserted into the recess 4 before sealing tape 16 is fitted into recess 4. After sealing tape 16 has been fitted into the recess 4, this insulating material is situated in intermediate space 36 between second layer 20 of sealing tape 16 and bottom 10 of recess 4 and fills this space at least partially or possibly completely.

A polyurethane foam, for example, can be injected into recess 4 as insulating material 38. Glass wool can also be used as insulating material 38, or any other type of material suitable for thermal insulation. The important point with respect to the choice of insulating material 38 is that no sealing function with respect to air drafts or driving rain must be present in intermediate space 36. The only requirement is that adequate thermal insulation be provided. Nevertheless, a compressible, flexible foam strip can also be used as insulating material 38, which is laid or pressed into recess 4. This flexible foam strip can be at least partially compressed when in the installed state. It is also possible, however, to use stiff second layer 20 to compress a fully expanded flexible foam strip toward bottom 10 of recess 4 as sealing tape 16 is being inserted.

Figure 6:
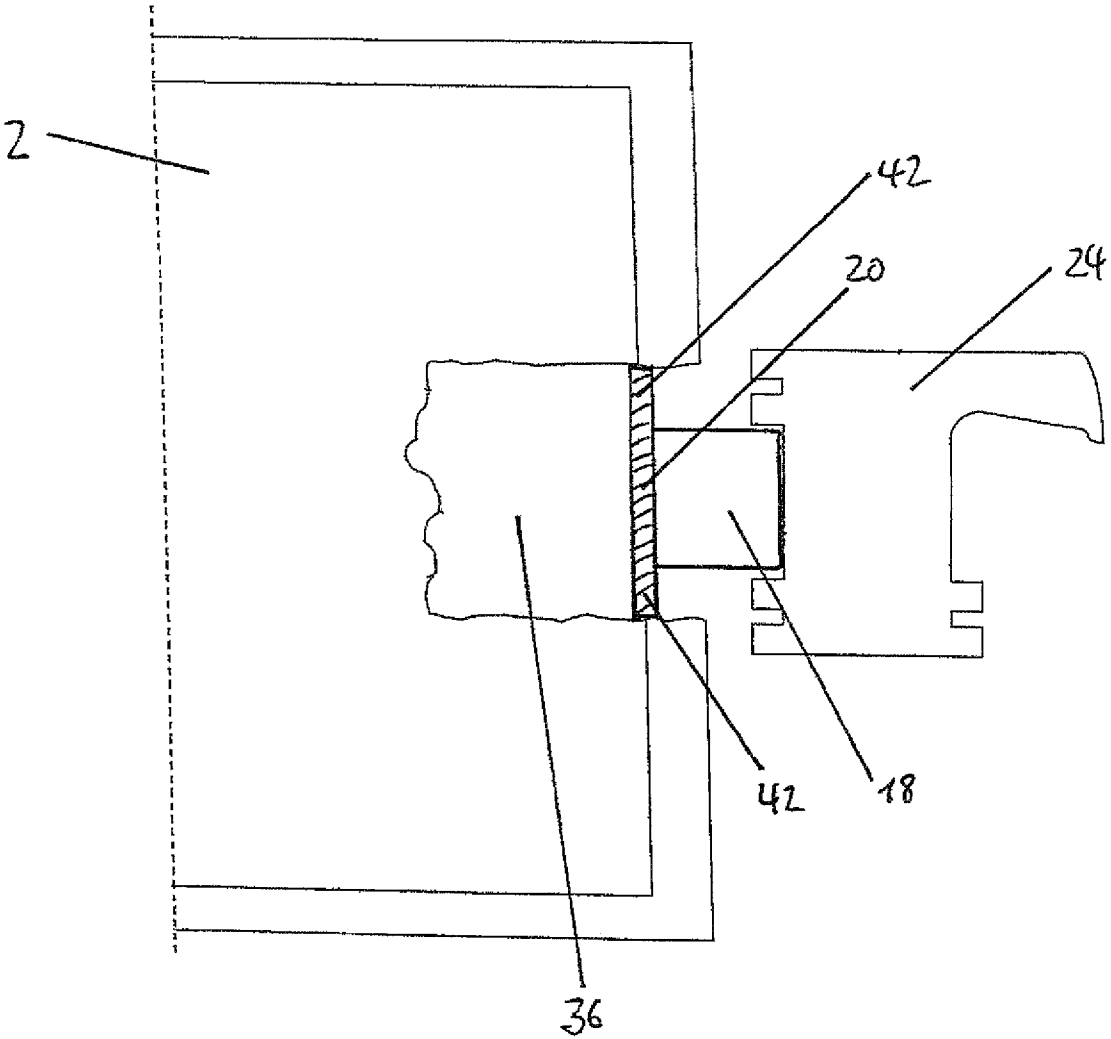
FIG. 6 is a cross-sectional view of the masonry of FIG. 1 with an installed window frame and another alternative sealing tape.

FIG. 6 shows another embodiment of sealing tape 16 in the desired functional state. The embodiment of sealing tape 16 shown in FIG. 6 can be combined with any of the other variants described here. In this embodiment, second layer 20 of the sealing tape comprises two clamping sections 42, which project laterally beyond first layer 18 of the sealing tape to allow second layer 20 to clamp itself against side walls 12 of recess 4. Thus, as shown in the example, even partial sections of a window frame 24 which are narrower than recess 4 can be homogeneously sealed.

Figure 7:
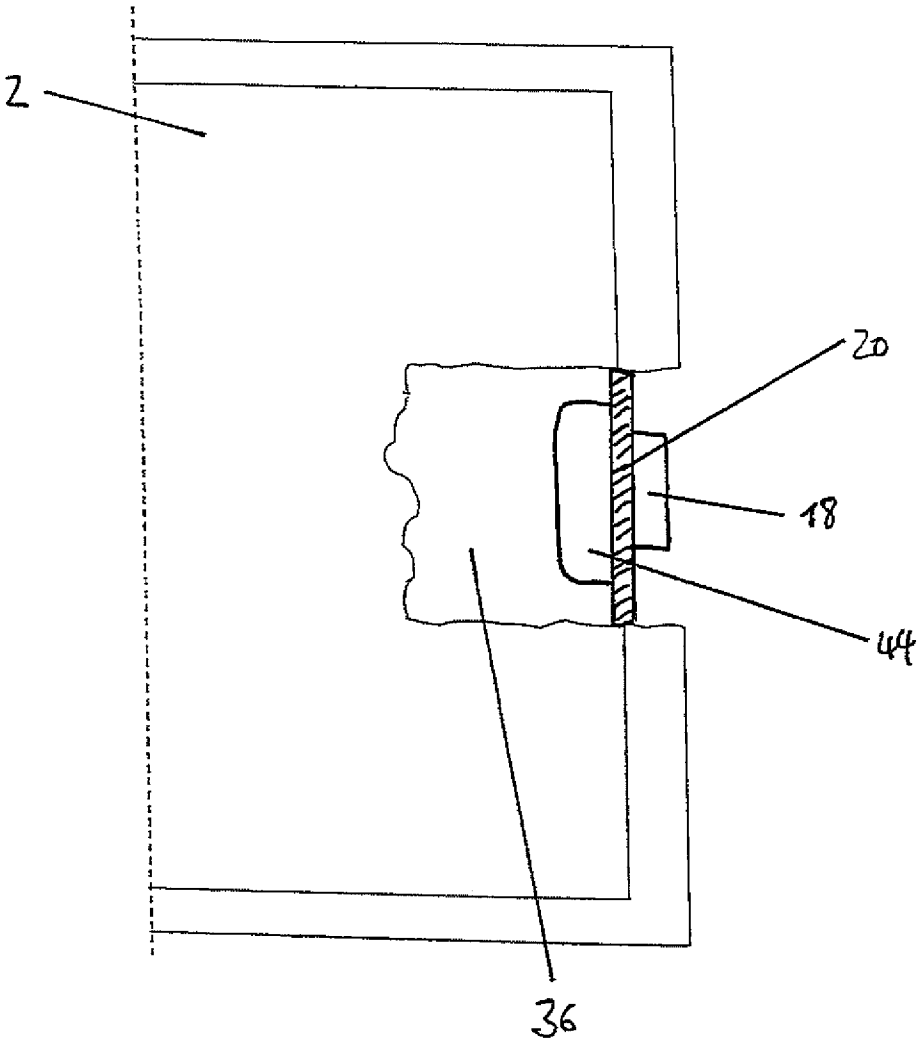
FIG. 7 is a cross-sectional view of the masonry of FIG. 1 with an inserted sealing tape according to another alternative design.
Figure 8:
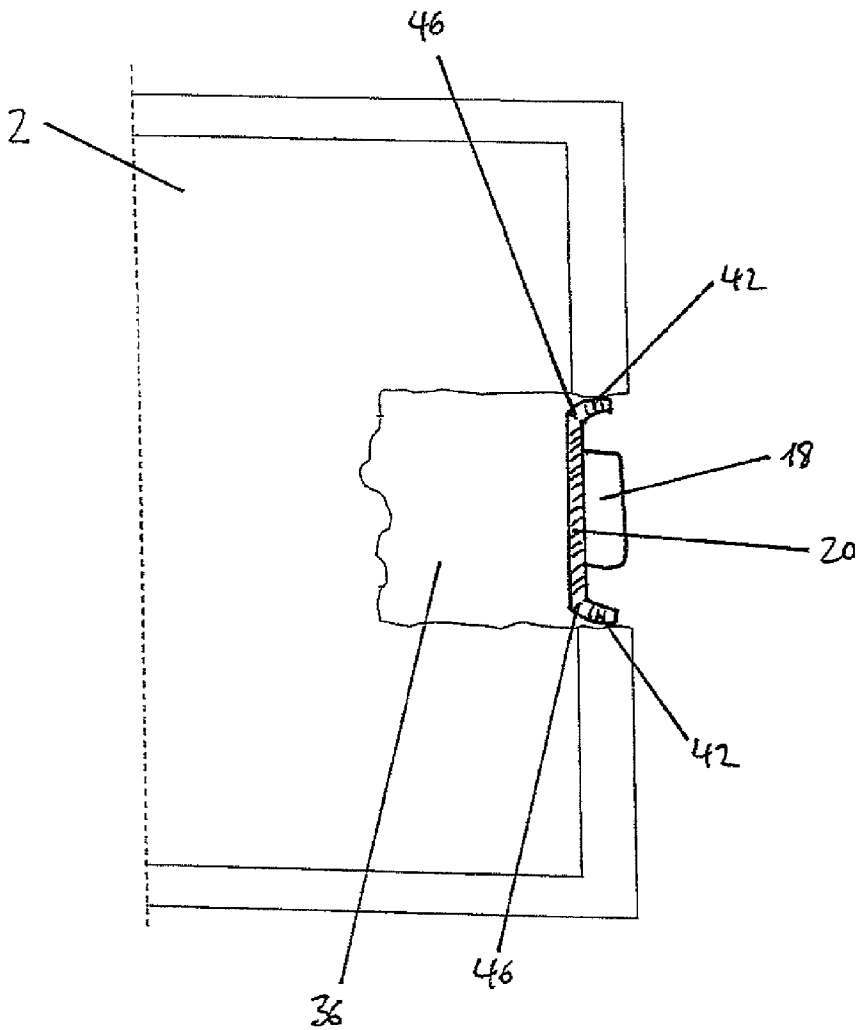
FIG. 8 is a cross-sectional view of the masonry of FIG. 1 with an inserted sealing tape according to another alternative design.
Figure 9:
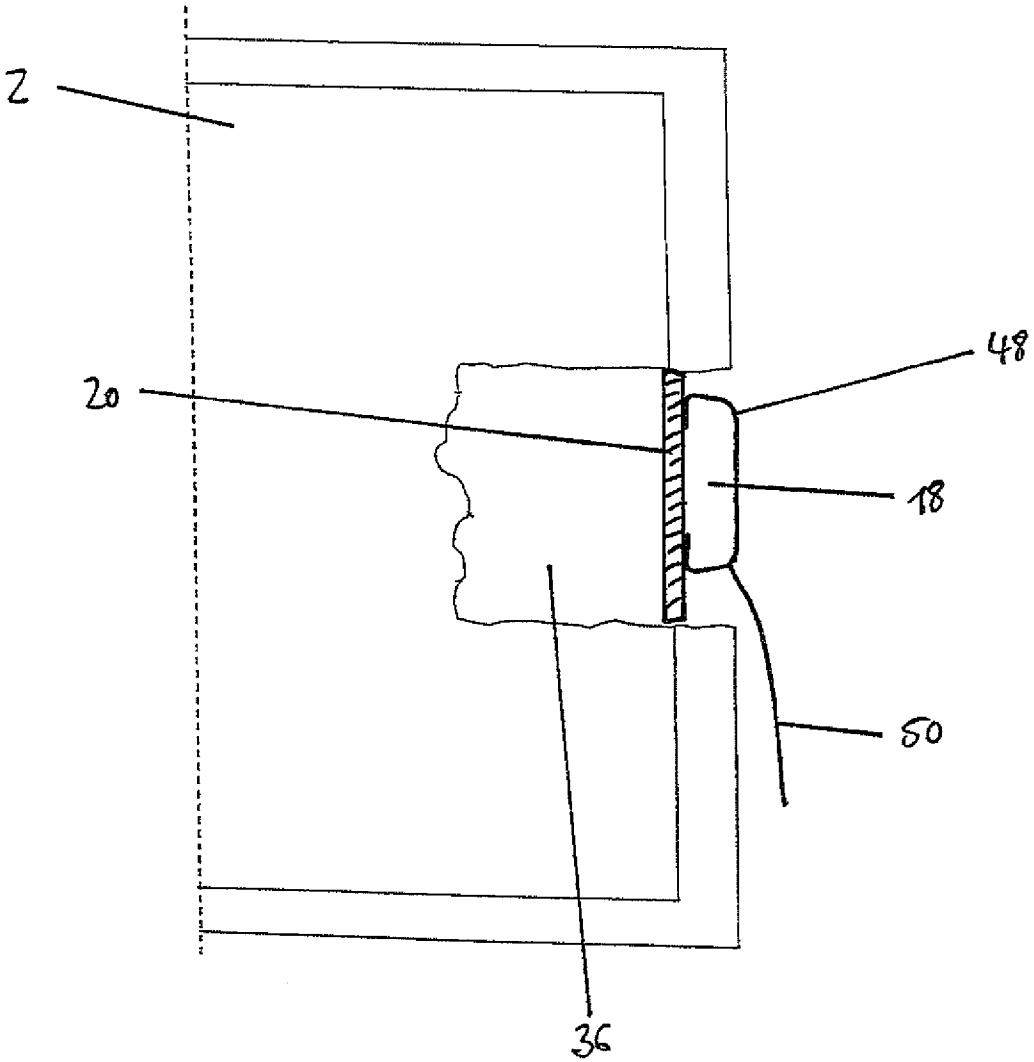
FIG. 9 is a cross-sectional view of the masonry of FIG. 1 with an inserted sealing tape according to another alternative design.

FIGS. 7-9 show additional embodiments of sealing tape 16 in the installed state, i.e., after its introduction into recess 4, but before window frame 24 has been put in place.

The alternative design of sealing tape 16 shown in FIG. 7 can again be combined with any of the other variants. As an elaboration of the embodiment of sealing tape 16 shown in FIG. 6, sealing tape 16 here comprises a third layer 44 of flexible foam, which is bonded to second layer 20 of the sealing tape on the side of second layer 20 opposite first layer 18, preferably again by means of an adhesive or by lamination.

After sealing tape 16 has been fitted into recess 4, this third layer 44 is therefore located in intermediate space 36 between the second layer of sealing tape 16 and bottom 10 of recess 4 and serves as thermal insulation for intermediate space 36. The presence of third layer 44 is especially advisable when recess 4 is quite deep and when no use is to be made of additional insulating material 38 (FIG. 5).

In the installed state, third layer 44 of the sealing tape is at least partially compressed. After sealing tape 16 has clamped itself in recess 4, the third layer expands toward bottom 10 of recess 4 in intermediate space 36 between second layer 20 of sealing tape 16 and bottom 10 of recess 4. The delayed recovery of third layer 44, like the recovery of first layer 18, is attributable to the impregnation of third layer 44 with a sticky impregnation agent.

In the completely relaxed state, third layer 44 can, for example, have a height in the range of 20-100 mm, preferably of 30-70 mm. Ideally, the height of third layer 44 will be selected so that, when in its functional state, third layer 44 rests against bottom 10 of recess 4.

The embodiment of sealing tape 16 shown in FIG. 8 corresponds to the embodiment of FIG. 6, wherein the two lateral clamping sections 42 are defined by two predetermined bending lines 46 in second layer 20 of sealing tape 16. Predetermined bending lines 46 are preferably introduced into second layer 20 of sealing tape 16 in such a way that two lateral clamping sections 42 fold over in opposite directions, i.e., toward open access section 14 of recess 4, upon the insertion of sealing tape 16 into recess 4. Because the material of second layer 20 tries to return to its original straight state, a property which is preferably provided, two clamping sections 42 clamp themselves even more effectively against side walls 12 of recess 4 and thus allow sealing tape 16 to be positioned precisely in recess 4. Clamping sections 42 can also be bent over in the reverse direction, that is, toward bottom 10 of recess 4, if, before sealing tape 16 is inserted, clamping sections 42 are preshaped or bent over in this direction.

The embodiment of sealing tape 16 shown in FIG. 9 again corresponds to the embodiment shown in FIG. 6, wherein first layer 18 of sealing tape 16 is at least partially surrounded by a sheet-like wrapping 48, which keeps first layer 18 at least partially compressed when in the inserted state. In the embodiment shown, wrapping 48 encloses three sides of first layer 18, whereas only two lateral edge sections of wrapping 48 are present on the fourth side of first layer 18, which is the side facing second layer 20. The lateral edge sections of wrapping 48 are held in place by bonding them to first layer 18 or to second layer 20 by the use of an adhesive.

When a wrapping 48 is used, flexible foams which do not have the property of delayed recovery can also be used as the material of first layer 18. After window frame 24 has been put in place, it is necessary only to open wrapping 48 or to remove it. After wrapping 48 has been removed, first layer 18 can expand toward window frame 24 without interference.

In the examples shown here, a pull tab 50 is provided on wrapping 48 to release first layer 18. When pull tab 50 is pulled, wrapping 48 in the example shown here is completely removed, because the adhesive bond of the lateral edge sections of wrapping 48 to first layer 18 or to second layer 20 cannot withstand the tensile force.

Wrapping 48 can also surround entire first layer 18 of the sealing tape. In this case, it is necessary for wrapping 48 to have at least one perforation line, which is torn apart when pull tab 50 is pulled.

Instead of the case in which the two lateral edge sections of wrapping 48 are folded over toward the inside, it is also possible for them to be attached to the outside areas of clamping sections 42 of second layer 20. Any other form of an at least partial wrapping can be considered, as long as wrapping 48 can keep first layer 18 in a partially compressed state and wrapping 48 can be opened or removed after window frame 24 has been put in place.

The material of wrapping 48 can be plastic sheet material, a mesh material, paper, or some other material which is suitable for the purpose in question. Laminated sheets consisting of a plastic sheet laminated to a backing material (e.g., a nonwoven) or fabric-reinforced sheets can also be used. All these materials are best described by the expression "sheet-like". Combinations of these materials are also possible. A thermoplastic sheet or a heat-shrink sheet, which contracts under the effect of heat, is preferred, however.

There are even more possible ways beyond those already given in which the sealing tape 16 can be embodied.

For example, second layer 20 can comprise longitudinal edge profiling in the form of waves or a zigzag pattern or have some other geometric form.

The sealing tape can also have more than the number of layers described here.

In all of the embodiments, second layer 20 of sealing tape 16 has been fastened to side walls 12 of recess 4 exclusively by a clamping effect. As an alternative, it is also possible to fasten second layer 20 to side walls 12 of recess 4 by the use of an adhesive. For this purpose, a suitable adhesive can be applied to side walls 12 of recess 4 or possibly only to predetermined sections of side walls 12 of recess 4 before sealing tape 16 is fitted into recess 4.

It is also conceivable that the side areas or other sections of second layer 20 of sealing tape 16 which come in contact with side walls 12 of recess 4 are provided with an adherent material such as with a butyl adhesive strip or a pressure-sensitive adhesive layer. The pressure-sensitive adhesive layer can also be applied, for example, to the entire surface of the side of second layer 20 facing bottom 10 of recess 4 or only to certain parts of that surface. The pressure-sensitive adhesive layer can be covered with a peel-off cover paper. The arrangement of the pressure-sensitive adhesive layer in this location is advantageous especially in cases where, as a result of the folding-over of clamping sections 42 of second layer 20, the areas provided with the pressure-sensitive adhesive are facing side walls 12 of recess 4. It is also conceivable that one could use adhesive strips projecting beyond second layer 20 or adhesive strips which extend from the bottom side of second layer 20 to the top side of second layer 20 in the form of a loop covering the side area of second layer 20 or projecting beyond it. Many other designs can also be imagined.

A combination of the application of an adhesive to sections or side areas of second layer 20 and the application to side walls 12 of recess 4 is also conceivable.

Essentially, the use of an adhesive can, alone or preferably jointly with the clamping effect, ensure that the sealing tape 16 is fastened securely in recess 4.

Reference throughout this specification to "the embodiment," "this embodiment," "the previous embodiment," "one embodiment," "an embodiment," "a preferred embodiment" "another preferred embodiment" "the example," "this example," "the previous example," "one example," "an example," "a preferred example t" "another preferred example" or similar language means that a particular feature, structure, or characteristic described in connection with the embodiment or example is included in at least one embodiment or example of the present invention. Thus, appearances of the phrases "in the embodiment," "in this embodiment," "in the previous embodiment," "in one embodiment," "in an embodiment," "in a preferred embodiment," "in another preferred embodiment," "in the example," "in this example," "in the previous example," "in one example," "in an example," "in a preferred example," "in another preferred example, and similar language throughout this specification may, but do not necessarily, all refer to the same embodiment.

Furthermore, the described features, advantages, and characteristics of the invention may be combined in any suitable manner in one or more embodiments or examples. One skilled in the relevant art will recognize that the invention may be practiced without one or more of the specific features or advantages of a particular embodiment or example. In other instances, additional features and advantages may be recognized in certain embodiments or examples that may not be present in all embodiments of the invention.

While the present invention has been described in connection with certain exemplary or specific embodiments or examples, it is to be understood that the invention is not limited to the disclosed embodiments or examples, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A method for sealing of replacement windows comprising the steps of:

providing a sealing tape comprising a first layer of flexible foam, which recovers after compression, and a second layer of stiff material, the first and second layers being bonded to each other;

inserting the sealing tape into a channel-shaped recess in masonry which is bounded by a bottom and two side walls and comprises an open access section, wherein the second layer of the sealing tape is arranged closer to the bottom of the recess than the first layer, and wherein the first layer of the sealing tape is at least partially compressed when in the inserted state;

fastening the second layer of the sealing tape in the recess at a predetermined distance from the open access section; and after the steps of inserting the sealing tape into the channel-shaped recess and fastening the second layer of the sealing tape in the recess, placing a window frame opposite the access section of the recess provided with the sealing tape, whereupon the first layer of the sealing tape expands until it rests against the window frame.

2. The method of claim 1, wherein the second layer of the sealing tape is made of stiff foam.

3. The method of claim 1, wherein the second layer of the sealing tape is clamped against the side walls of the recess.

4. The method of claim 3, wherein the second layer of the sealing tape comprises predetermined bending lines to define two lateral clamping sections.

5. The method of claim 4, wherein the two lateral clamping sections bend over in opposite directions toward the open access section upon insertion of the sealing tape into the recess.

6. The method of claim 1, wherein the second layer of the sealing tape is fastened to the side walls of the recess by an adhesive.

7. The method of claim 1, wherein the first layer and the second layer of the sealing tape are permanently bonded to each other.

8. The method of claim 1, wherein the first layer of the sealing tape is provided with a sticky impregnation agent, which delays recovery of the first layer after compression.

9. The method of claim 1, wherein the first layer of the sealing tape is at least partially surrounded by a wrapping, which keeps the first layer at least partially compressed while in the inserted state, wherein the wrapping is opened or removed after the window frame is put in place.

10. The method of claim 1, wherein the predetermined distance is in the range of 2 to 20 mm.

11. The method of claim 1, wherein the sealing tape comprises a third layer of flexible foam which recovers after compression, which is bonded to the second layer of the sealing tape on the side of the second layer facing away from the first layer and, after insertion of the sealing tape into the recess, is located in an intermediate space between the second layer of the sealing tape and the bottom of the recess.

12. The method of claim 11, wherein the third layer of the sealing tape is at least partially compressed when in the inserted state, and, after the sealing tape has been clamped in the recess, the third layer of the sealing tape expands toward the bottom of the recess in the intermediate space between the second layer of the sealing tape and the bottom of the recess.

13. The method of claim 1, wherein, before the sealing tape is fitted into the recess, insulating material is inserted into the recess, which material is located, after the sealing tape has been fitted into the recess, in an intermediate space between the second layer of the sealing tape and the bottom of the recess.

14. The method of claim 13, wherein the insulating material is a compressible, flexible foam strip.

15. The method of claim 13, wherein the insulating material is a polyurethane foam, which is injected into the recess.

* * * * *